US005314224A

United States Patent [19]

Bates

[11] Patent Number: 5,314,224

[45] Date of Patent: May 24, 1994

[54] TOP GRIPPING BOTTLE ENGAGING DEVICE

[75] Inventor: Aaron Bates, Smyrna, Ga.

[73] Assignee: The Mead Corporation, Dayton, Ohio

[21] Appl. No.: 91,394

[22] Filed: Jul. 12, 1993

Related U.S. Application Data

[63] Continuation of Ser. No. 961,258, Oct. 15, 1992, abandoned.

[51] Int. Cl.[5] ..... B65D 85/62; B65D 71/00

[52] U.S. Cl. ..... 294/87.2; 206/158

[58] Field of Search ..... 294/87.1, 87.2, 87.26, 294/87.28; 206/145, 147, 151, 152, 153, 158

[56] References Cited

U.S. PATENT DOCUMENTS

| | | | |
|---|---|---|---|
| 2,252,235 | 8/1941 | Snelling | 206/158 X |
| 2,320,440 | 6/1943 | Kruea et al. | 294/87.26 |
| 2,860,281 | 1/1975 | Wood | 294/87.2 |
| 3,016,259 | 1/1962 | Lawrence | 206/153 X |
| 3,073,644 | 1/1963 | Baker et al. | 206/158 X |
| 3,640,563 | 2/1972 | Wood | 206/145 X |
| 4,318,476 | 3/1982 | Wood et al. | 294/87.2 X |
| 4,736,977 | 4/1988 | Killy | 294/87.2 |

*Primary Examiner*—Dean J. Kramer
*Attorney, Agent, or Firm*—Rodgers & Rodgers

[57] ABSTRACT

A bottle top engaging device is formed from a unitary blank which includes foldably joined main and auxiliary panels. Apertures of keyhole configuration are formed in both the main and auxiliary panels. A connector panel is foldably joined to one side edge of the main panel and is foldably joined on the other side edge to a stabilizing panel in which cutaway areas are formed and which complement the keyhole configuration of the apertures formed in the main and auxiliary panels. The invention is particularly applicable for use in conjunction with heavy duty bottles having flanged necks.

8 Claims, 2 Drawing Sheets

TOP GRIPPING BOTTLE ENGAGING DEVICE

This application is a continuation of application Ser. No. 07/961,258, filed Oct. 15, 1992 now abandoned.

TECHNICAL FIELD

The invention pertains to transporting a plurality of heavy bottles having flanged neck portions.,

BACKGROUND ART

U. S. Pat. No. 2,252,235 issued Aug. 12, 1941 discloses an arrangement wherein a bottle carrier of the top gripping type is disclosed and which utilizes structures which include apertures which are of keyhole configuration.

U. S. Pat. No. 2,320,440 issued Jun. 1, 1943 discloses a top gripping bottle carrier wherein panels include apertures of keyhole configuration and which are disposed about and grip the necks of packaged bottles.

U. S. Pat. No. 2,337,243 issued Dec. 21, 1943 discloses a top gripping bottle carrier wherein some of the bottle neck receiving apertures are of keyhole configuration.

SUMMARY OF THE INVENTION

According to this invention in one form, a unitary blank having a main panel, an auxiliary panel foldably joined along a side edge thereof to the main panel utilizes a connector panel interconnected between one side edge of the main panel and a side edge of a stabilizing panel. The main panel includes keyhole apertures and the auxiliary panel as well as the stabilizing panel include apertures which are configured in part of keyhole configuration. Also apertures formed in the auxiliary panel extend into a securing panel foldably joined to the auxiliary panel and used to secure the blank about the associated bottles.

BEST MODE OF CARRYING OUT THE INVENTION

Figure 1:
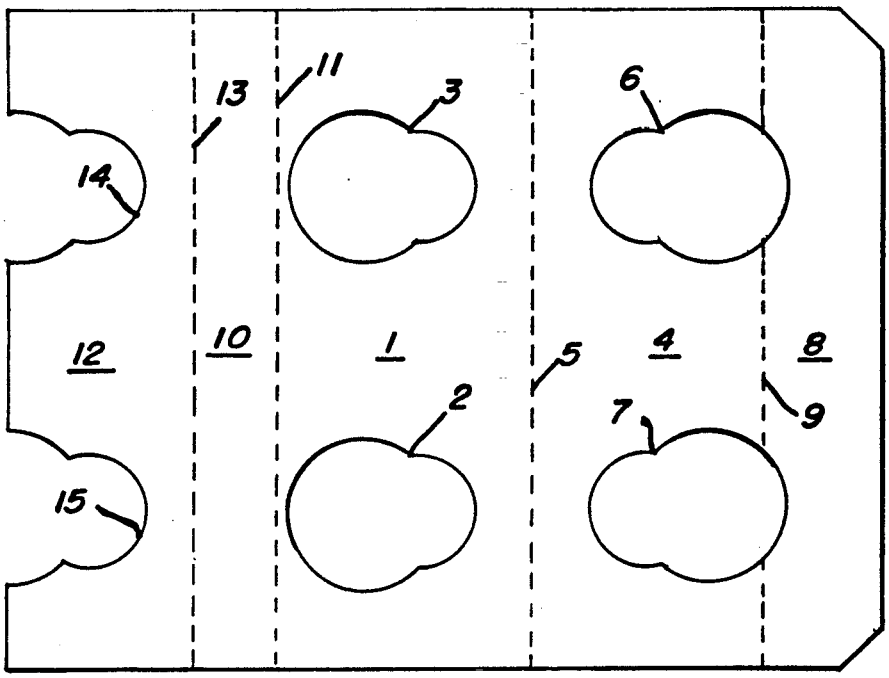
FIG. 1 is a plan view of a blank such as might be formed from heavy duty paperboard.

With reference to FIG. 1, the numeral 1 designates a main panel in which a plurality of apertures 2 and 3 are formed and which are of keyhole configuration. An auxiliary panel 4 is foldably joined to main panel 1 along fold line 5 and a plurality of apertures 6 and 7 are of keyhole configuration and are formed in auxiliary panel 4.

A securing panel 8 is foldably joined to auxiliary panel 4 along fold line 9.

Figure 2:
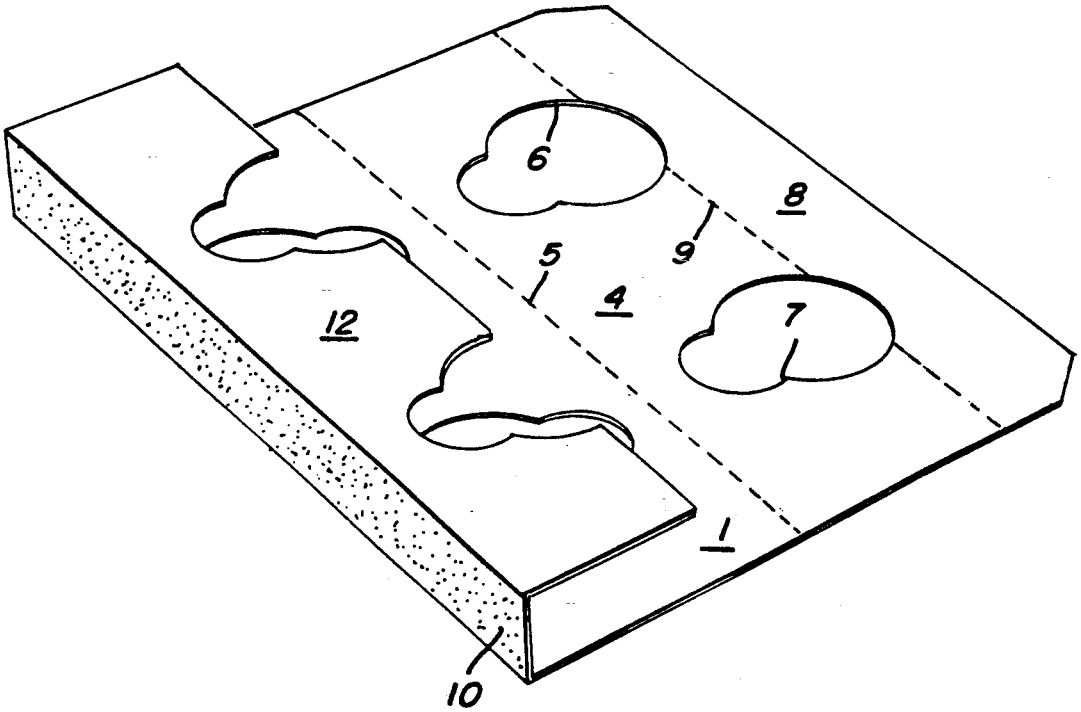
FIG. 2 shows the blank of FIG. 1 in a partially manipulated condition.
Figure 3:
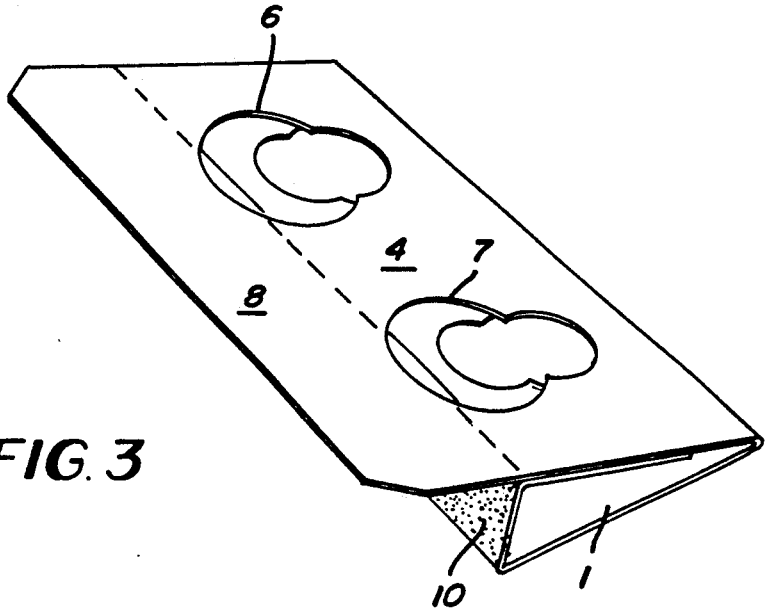
FIGS. 3 and 4 show subsequent stages through which the blank of FIG. 1 is manipulated to form a completed structure such as that shown in fragmentary form in FIG. 5.
Figure 4:
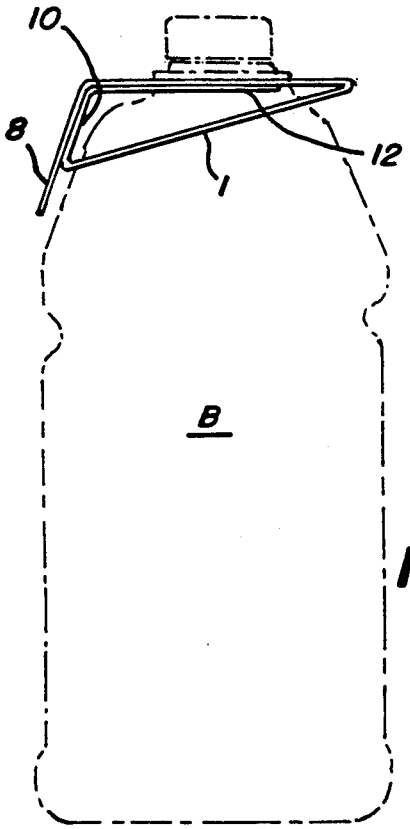
Figure 5:
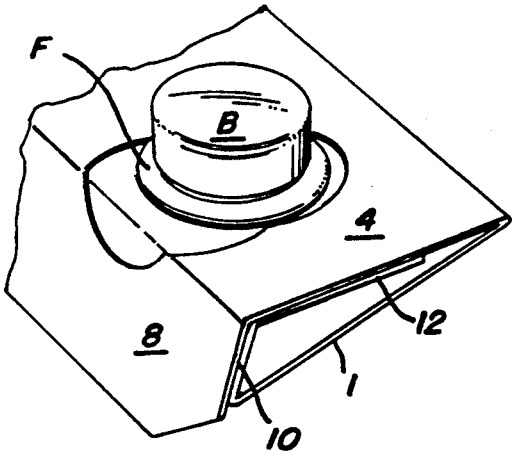

At the other end of the blank, a connector panel 10 is foldably joined to main panel 1 along fold line 11 and a stabilizing panel 12 is foldably joined to connector panel 10 along fold line 13. A pair of apertures 14 and 15 are formed in stabilizing panel 12 and cooperate with keyhole apertures formed in main and auxiliary panels 1 and 4. In order to form the complete package as shown in FIGS. 4 and 5 f rom the blank shown in FIG. 1, the parts are manipulated in such manner as to loosely engage the necks of the bottles to be packaged. Thereafter connector panel 10 is pushed toward the bottles causing the keyholes to interlock underneath the neck flanges such as indicated at F in FIG. 5. This action causes the bottles to assemble in a tight group and the bottle group is maintained in this condition by the securement of securing panel 8 in flat face contacting relation with the connector panel 10 which of course is effected in known manner by means of glue as shown by stippling in FIGS. 2 and 3.

By this invention, a plurality of heavy bottles may be arranged in a compact group of articles thereby minimizing the chance of breakage due to collision between the heavy duty items. Also it is obvious that the invention is applicable not only to two articles to be assembled but to additional articles if desired.

I claim:

1. A top gripping bottle engaging device for gripping a plurality of bottles at bottle necks thereof, said device comprising:

a main panel having opposed side edges and a plurality of bottle neck receiving apertures formed therein;

an auxiliary panel foldably joined to one of said side edges of said main panel and having a plurality of bottle neck receiving apertures formed therein;

a connector panel foldably joined along one of opposed side edges thereof to the other side edge of said main panel;

a stabilizing panel foldably joined along one of opposed side edges thereof to the other side edge of said connector panel and having a plurality of bottle neck receiving cutaway areas formed along the other side edge of said stabilizing panel, each of said cutaway areas extending from said other side edge of said stabilizing panel inwardly of said stabilizing panel wherein said cutaway areas are open along said other side edge of said stabilizing panel, said stabilizing and auxiliary panels being disposed in mutually superposed relation such that said main, auxiliary, connector and stabilizing panels form a tubular structure of a generally triangular cross section including a composite top wall formed from said stabilizing and auxiliary panels and such that said cutaway areas cooperate with said apertures of said auxiliary panel to cause said composite top wall to engage said bottle necks; and means for maintaining said device in a tubular assembled condition.

2. A device according to claim 1, wherein said maintaining means comprises a securing panel foldably joined to said auxiliary panel and affixed to said connector panel.

3. A device according to claim 1, wherein said main and auxiliary panels define an acute angle therebetween.

4. A device according to claim 3, wherein said main panel is disposed under said composite top wall.

5. A top gripping bottle engaging device for gripping a plurality of bottles at bottle necks thereof, said device comprising:

a main panel having opposed side edges and a plurality of bottle neck receiving apertures formed therein;

an auxiliary panel foldably joined to one of said side edges of said main panel and having a plurality of bottle neck receiving apertures formed therein;

a connector panel foldably joined along one of opposed side edges thereof to the other side edge of said main panel;

a stabilizing panel foldably joined along one of opposed side edges thereof to the other side edge of said connector panel and having a plurality of bottle neck receiving cutaway areas formed along the other side edge of said stabilizing panel, said stabilizing and auxiliary panels being disposed in mutually superposed relation such that said main, auxiliary, connector and stabilizing panels form a tubular structure of a generally triangular cross section including a composite top wall formed from said stabilizing and auxiliary panels and such that said cutaway areas cooperate with said apertures of said auxiliary panel to cause said composite top wall to engage said bottle necks; and means for maintaining said device in a tubular assembled condition;

said bottle neck receiving apertures formed in said main and said auxiliary panels being of key hole configuration.

6. A top gripping bottle engaging device for gripping a plurality of bottles at bottle necks thereof, said device comprising:

a main panel having opposed side edges and a plurality of bottle neck receiving apertures formed therein;

an auxiliary panel foldably joined to one of said side edges of said main panel and having a plurality of bottle neck receiving apertures formed therein;

a connector panel foldably joined along one of opposed side edges thereof to the other side edge of said main panel;

a stabilizing panel foldably joined along one of opposed side edges thereof to the other side edge of said connector panel and having a plurality of bottle neck receiving cutaway areas formed along the other side edge of said stabilizing panel, said stabilizing and auxiliary panels being disposed i mutually superposed relation such that said main, auxiliary, connector and stabilizing panels form a tubular structure of a generally triangular cross section including a composite top wall formed from said stabilizing and auxiliary panels and such that said cutaway areas cooperate with said apertures of said auxiliary panel to cause said composite top wall to engage said bottle necks; and means for maintaining said device in a tubular assembled condition;

said neck receiving apertures formed in said main panel and in said auxiliary panel are spaced approximately equidistant from said side edge which adjoins said main and said auxiliary panels.

7. A top gripping bottle engaging device for gripping a plurality of bottles at bottle necks thereof, said device comprising:

a main panel having opposed side edges and a plurality of bottle neck receiving apertures formed therein;

an auxiliary panel foldably joined to one of said side edges of said main panel and having a plurality of bottle neck receiving apertures formed therein;

a connector panel foldably joined along one of opposed side edges thereof to the other side edge of said main panel;

a stabilizing panel foldably joined along one of opposed side edges thereof to the other side edge of said connector panel and having a plurality of bottle neck receiving cutaway areas formed along the other side edge of said stabilizing panel, said stabilizing and auxiliary panels being disposed in mutually superposed relation such that said main, auxiliary, connector and stabilizing panels form a tubular structure of a generally triangular cross section including a composite top wall formed from said stabilizing and auxiliary panels and such that said cutaway areas cooperate with said apertures of said auxiliary panel to cause said composite top wall to engage said bottle necks; and means for maintaining said device in a tubular assembled condition;

said apertures in said main and auxiliary panels are of the same configuration, and said cutaway areas of said stabilizing panel are of a configuration which coincides with a part of said configuration of said apertures in said main and auxiliary panels.

8. A top gripping bottle engaging device for gripping a plurality of bottles at bottle necks thereof, said device comprising:

a main panel having opposed side edges and a plurality of bottle neck receiving apertures formed therein;

an auxiliary panel foldably joined to one of said side edges of said main panel and having a plurality of bottle neck receiving apertures formed therein;

a connector panel foldably joined along one of opposed side edges thereof to the other side edge of said main panel;

a stabilizing panel foldably joined along one of opposed side edges thereof to the other side edge of said connector panel and having a plurality of bottle neck receiving cutaway areas formed along the other side edge of said stabilizing panel, said stabilizing and auxiliary panels being disposed in mutually superposed relation such that said main, auxiliary, connector and stabilizing panels form a tubular structure of a generally triangular cross section including a composite top wall formed from said stabilizing and auxiliary panels and such that said cutaway areas cooperate with said apertures of said auxiliary panel to cause said composite top wall to engage said bottle necks; and means for maintaining said device in a tubular assembled condition;

said main and auxiliary panels define an acute angle therebetween;

and each of said composite top wall and said main and connector panels extends along a width disposed perpendicular to the axis of said tubular structure, said main panel being greater in width than said composite wall, and said composite wall being greater in width than said connector panel.

* * * * *

UNITED STATES PATENT AND TRADEMARK OFFICE

CERTIFICATE OF CORRECTION

PATENT NO. : 5,314,224
DATED : May 24, 1994
INVENTOR(S) : Aaron Bates

It is certified that error appears in the above-indentified patent and that said Letters Patent is hereby corrected as shown below:

On the Title page, item [56], under References Cited insert--

| Document Number | Date | Country |
|---|---|---|
| 1323 011 | 7/73 | Great Britain |

Signed and Sealed this

Twentieth Day of September, 1994

*Attest:*

*Attesting Officer*

BRUCE LEHMAN

*Commissioner of Patents and Trademarks*